United States Patent [19]

Mains

[11] Patent Number: 4,613,079

[45] Date of Patent: Sep. 23, 1986

[54] FUEL NOZZLE WITH DISC FILTER

[75] Inventor: Robert T. Mains, Euclid, Ohio

[73] Assignee: Parker-Hannifin Corporation, Cleveland, Ohio

[21] Appl. No.: 664,464

[22] Filed: Oct. 25, 1984

[51] Int. Cl.[4] ..... B05B 1/34

[52] U.S. Cl. ..... 239/462; 239/492; 239/600

[58] Field of Search ..... 239/462, 472, 474, 475, 239/490–493, 495, 533.2, 533.12, 553.3, 575, 590.3, 600

[56] References Cited

U.S. PATENT DOCUMENTS

| | | | |
|---|---|---|---|
| 995,981 | 6/1911 | Mills | 239/462 |
| 1,309,922 | 7/1919 | Ward | 239/553.3 X |
| 1,693,931 | 12/1928 | Lowe | 239/533.12 X |
| 2,050,368 | 8/1936 | Neely | 239/462 X |
| 2,319,767 | 5/1943 | Murphy | 239/491 |
| 2,494,590 | 1/1950 | Smith | 239/462 |
| 2,562,731 | 7/1951 | Murphy | 239/493 |
| 2,574,865 | 11/1951 | Edwards | 239/462 |
| 2,772,120 | 11/1956 | Olson | 239/462 |
| 2,823,954 | 2/1958 | Olson | 239/462 |

FOREIGN PATENT DOCUMENTS

| | | | |
|---|---|---|---|
| 990237 | 9/1951 | France | 239/462 |

*Primary Examiner*—Johnny D. Cherry

*Attorney, Agent, or Firm*—Frederick L. Tolhurst

[57] ABSTRACT

A fuel nozzle tip having primary and secondary circuits wherein a disc-shaped filter (54) is clamped against the primary body (12) by a retainer plug (56), and wherein the filter cooperates with the primary body to secure the swirl plug (38) in compression therebetween.

9 Claims, 2 Drawing Figures

FUEL NOZZLE WITH DISC FILTER

BACKGROUND OF THE INVENTION

1. Field of the Invention

The subject invention is directed to fuel nozzles that provide a controlled spray pattern and, more particularly, to means for filtering fluid flow through such nozzles.

2. Description of the Prior Art

As well known in the art, fuel nozzles generally include a nozzle tip in combination with a holder. The nozzle tip, by its particular structure, determines and controls the spray pattern. The nozzle tip is mounted in the holder which provides fluid flow to the nozzle tip and positions the tip at a particular location and orientation.

Conventional nozzle tips generally include a body having a discharge orifice at one end, and an internal member that swirls the fluid flowing to the orifice. Typically, this member is referred to as a swirl plug and accomplishes the swirling action through various arrangements of vanes, slots, or passageways. Nozzle tips having a dual circuit, that is, a primary and secondary flow path, generally further include a second body concentrically located in the first body and having a primary spray orifice located adjacent to the discharge orifice of the outer body. In these nozzles, the swirl plug is typically located in a cavity in the primary body. In any case it is important to secure the swirl plug firmly in the nozzle tip to prevent leakage at the metal-to-metal seal face between the swirl plug and the body. This leakage can cause unacceptable deviations in flow calibration and spray pattern.

In some nozzle tips, the swirl plug is secured by being press fitted or otherwise permanently fastened to the body. However, it is preferred that the swirl plugs be removably secured in the nozzle tip so that the nozzles are capable of being serviced. Thus, various types of coil springs, spring washers and other mechanisms for retaining the swirl plug in the nozzle tip have been developed in the prior art.

Also in the prior art, many mechanisms for filtering the fluid flowing to various types of nozzles are known. For example, filters are sometimes placed at the inlet to the nozzle holder. However, it is preferable to locate the filter as close to the nozzle tip as possible so that it can filter out any chips or other particles remaining in the nozzle from its manufacture or installation. Most preferably, the filter is located adjacent to the nozzle tip so that it will also filter out carbon particles or other contaminants that develop in the upstream portions of the nozzle during its use.

However, in the prior art, the structure of the nozzle tip often allowed insufficient space to accommodate the filter. In the subject invention, it was recognized that a filter that could retain the swirl plug would simplify the nozzle tip by eliminating the need for separate coil springs or other means for retaining the swirl plug. Thus, such a filter could be located in a preferred position inside the nozzle tip.

SUMMARY OF THE INVENTION

In accordance with the subject invention, a fuel nozzle tip includes a body that forms a discharge orifice at one end. The body also includes an inner cavity and a support surface that is adjacent the inner cavity. A swirl plug that is maintained in the inner cavity includes means for swirling fluid that flows through the nozzle tip toward the discharge orifice. A filter that is also maintained in the inner cavity has one face that contacts both the support surface of the nozzle and the swirl plug. A retainer plug is removably secured in the end of the cavity that is oppositely disposed from the discharge orifice. The retainer plug includes a clamping surface that cooperates with the support surface of the body to clamp the filter in position. The swirl plug is dimensioned such that it is maintained in compression between the filter and the body to secure the swirl plug against the nozzle body.

Preferably, the filter is in the general shape of a disc and has a multiplicity of holes for fluid flow from the retainer plug to the swirl plug. Also preferably, the swirl plug is dimensioned such that it extends to a longitudinal position that is offset from the longitudinal position of the support surface in the direction away from the discharge orifice. In this way, the filter is deflected to maintain the swirl plug in compression between the filter and the body.

Other details, objects and advantages of the subject invention will become apparent from the following description of a presently preferred embodiment thereof.

BRIEF DESCRIPTION OF THE DRAWINGS

The accompanying drawings show a presently preferred embodiment of the subject invention wherein.

PREFERRED EMBODIMENT OF THE SUBJECT INVENTION

Figure 1:
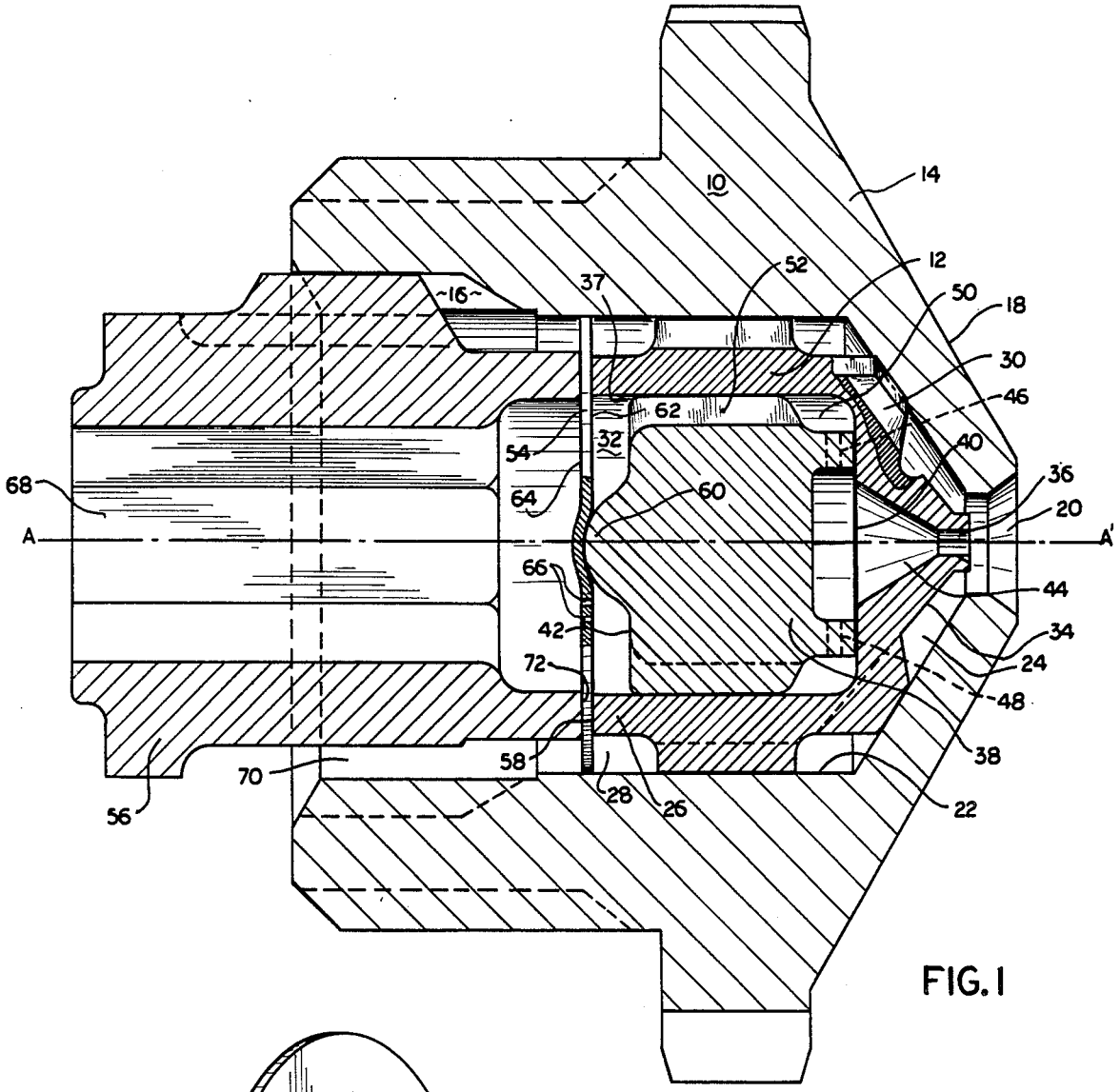
FIG. 1 is an elevational cross-section of a fuel nozzle tip in accordance with the subject invention.

As shown in FIG. 1, a nozzle tip in accordance with the subject invention includes a nozzle body 10. The subject invention is applicable to a single circuit or "simplex" tip as well as a dual circuit nozzle tip having both primary and secondary flow paths. However, for purposes of illustrating a preferred embodiment, the nozzle body 10 is a dual circuit nozzle wherein nozzle body 10 includes a primary body 12 and an outer body 14. Outer body 14 includes a cavity 16 and forms a discharge face 18 having a discharge orifice 20. Primary body 12 is located in cavity 16 and is laterally maintained by cavity wall 22.

Primary body 12 cooperates with outer body 14 to form a swirl annulus 24 that communicates with the inlet end 26 of primary body 12 through passageways 28. Primary body 12 includes a plurality of tangential slots 30 that are located on the peripheral surface of primary body 12 and extend through swirl annulus 24. As well known in the art swirl slots 30 impart a swirling motion to fluid flowing through swirl annulus 24.

Primary body 12 further includes an internal cavity 32 and forms a discharge face 34 that includes a primary orifice 36. Primary orifice 36 is concentrically arranged adjacent to discharge orifice 20.

The wall 37 of cavity 32 in primary body 12 provides lateral support for a swirl plug 38. Swirl plug 38 includes a discharge end 40 and an inlet end 42 with discharge end 40 cooperating with primary body 12 to form a swirl chamber 44 adjacent primary orifice 36. Swirl plug 38 includes two passageways 46 and 48 that are provided in discharge end 40. Swirl plug 38 further includes an annular gap 50 that communicates with passageways 46 and 48 and with passageways 52 such that fluid provided to the inlet end 42 of swirl plug 38 flows through passageways 52, annular gap 50, and passageways 46 and 48 into swirl chamber 44.

Passageways 46 and 48 are aligned tangential to the longitudinal axis A-A' of the nozzle tip and are offset from that axis such that a swirling motion is imparted to fuel flowing therethrough in a manner well known in the art. Alternatively, swirl plug 38 can have one to four slots and, in some cases, even more. From swirl chamber 44, the fluid flows through primary orifice 36 and selectively combines with fuel flowing from swirl annulus 24 through discharge orifice 20 to provide a controlled spray pattern.

With particular regard to the subject invention, primary body 12 cooperates with a filter 54 and a retainer plug 56 to maintain swirl plug 38 in cavity 32 of primary body 12 and secure swirl plug 38 tightly against primary body 12 at the discharge end 40. Primary body 12 includes a support surface 58 located at inlet end 26. Swirl plug 38 includes an extension member 60 located at inlet end 42. Swirl plug 38 and, in particular, extension member 60 are dimensioned such that extension member 60 extends to a longitudinal position that is offset from the longitudinal position of support surface 58 and in a direction away from discharge orifice 20.

Figure 2:
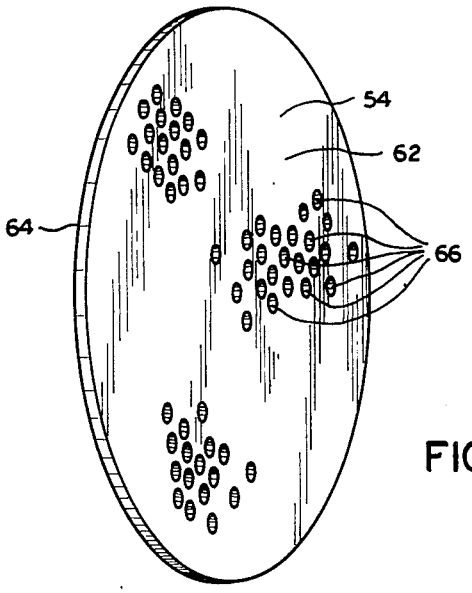
FIG. 2 is a perspective view of the filter shown in FIG. 1.

As shown in FIGS. 1 and 2, filter 54 is a generally disc-shaped member having oppositely disposed faces 62 and 64. Filter 54 is also provided with a multiplicity of holes 66 that provide fluid to primary passageways 52 and secondary passageways 28. Filter 54 is laterally maintained in cavity 16 by cavity wall 22.

A retainer plug 56 is threadingly engaged with cavity wall 22 and includes a central passage 68 to provide primary fuel flow to filter 54. Retainer plug 56 also includes peripheral passages 70 to provide secondary fuel flow to filter 54. Also, retainer plug 56 is provided with a clamping surface 72 such that when retainer plug 56 is sufficiently torqued into nozzle body 10, filter 54 is clamped between clamping surface 72 and support surface 58.

Filter 54 also contacts extension 60 of swirl plug 38. However, because the longitudinal position of extension 60 is offset further from primary orifice 36 than support surface 58, filter 54 is deflected at the center with respect to its periphery. The elastic recovery of filter 54 is such that filter 54 and primary body 12 cooperate to maintain swirl plug 38 in compression therebetween. Thus, swirl plug 38 is secured in the nozzle tip against vibrations, thermal variations and other factors that would tend to cause movement of swirl plug 38 and leakage of the metal-to-metal seal between discharge end 40 and primary body 12. Moreover, since filter 54 is used to hold swirl plug 38 in compression, it has a preferred location close to the orifice of the nozzle tip.

While a presently preferred embodiment of the invention is shown and described herein, the subject invention is not limited thereto, but can be otherwise variously embodied within the scope of the following claims.

I claim:

1. A nozzle tip comprising:

a nozzle body having at least one inner cavity and forming a discharge face with at least one discharge orifice therein, said nozzle body also providing a support surface adjacent the wall of said inner cavity;

a swirl plug that is maintained in the inner cavity of said nozzle body, said swirl plug having means for swirling fluid flowing through said inner cavity toward the discharge orifice of said nozzle body;

a filter that is maintained in the inner cavity of said nozzle body, said filter having first and second oppositely disposed faces with the first face contacting both the support surface of said nozzle body and said swirl plug; and a retainer plug that is removably secured in the cavity of said nozzle body, said retainer plug having a clamping surface that contacts the second face of said filter and maintains the first face of said filter in contact with both the support surface and said swirl plug, such that said filter cooperates with said nozzle body to maintain said swirl plug in compression therebetween.

2. The nozzle tip of claim 1 wherein said filter is a disc shaped member that includes a multiplicity of holes to provide fluid communication between said retainer plug and said swirl plug.

3. The nozzle tip of claim 1 or 2 wherein said swirl plug has a discharge end that is in communication with the discharge orifice of said nozzle body and an inlet end that is oppositely disposed from the discharge end and that includes an extension member, said extension member having a longitudinal location in the inner cavity of said nozzle body that is offset from the longitudinal location of said support surface in the direction away from the discharge orifice.

4. A nozzle tip assembly comprising:

a nozzle body having at least one inner cavity and forming a discharge face with at least one orifice therein, said nozzle body also forming a support surface adjacent the wall of said inner cavity;

a swirl plug that is laterally maintained by the walls of the inner cavity of said nozzle body, said swirl plug having a discharge end in communication with the discharge orifice of said nozzle body and having an inlet end that is oppositely disposed from said discharge end, said swirl plug also having means for swirling fluid flowing from said inlet end to said discharge end;

a filter that is laterally maintained in the inner cavity of said nozzle body, said filter having first and second oppositely disposed faces, with the first face contacting both the support surface of said nozzle body and said swirl plug; and a retainer plug that is removably secured in the cavity of said nozzle body, said retainer plug having a clamping surface that clamps the second face of said filter and maintains the first face of said filter in contact with the support surface and with said swirl plug, the portion of said filter contacting the swirl plug being longitudinally deflected with respect to the portion of said filter that is clamped between said support surface and the clamping surface of said retainer plug to maintain said swirl plug in compression between said filter and said nozzle body.

5. The tip assembly of claim 4 wherein said nozzle body includes a primary body and an outer body with the primary body being maintained in an internal cavity of the outer body.

6. The tip assembly of claim 4 or 5 wherein said filter is a disc shaped member that includes a multiplicity of holes that provide fluid communication between said retainer plug and the inlet end of said swirl plug.

7. The tip assembly of claim 4 or 5 wherein said filter is a perforated disc.

8. The tip assembly of claim 4 or 5 wherein the inlet end of said swirl plug is provided with an extension member that contacts said filter.

9. A tip assembly for nozzles, said tip assembly comprising:

a nozzle body having an inner cavity and forming a discharge face with a discharge orifice at one end;

a primary body that is maintained in the inner cavity of said nozzle body, said primary body having a cavity and forming a discharge end with a primay flow orifice that is located adjacent the discharge orifice, and having an inlet end that is oppositely disposed from the discharge end and that provides a support surface;

a swirl plug located in the cavity of said primary body, said swirl plug having a discharge end that cooperates with said primary body to form a swirl chamber adjacent said primary flow orifice, said swirl plug having an inlet end that is oppositely disposed from said discharge end, said inlet end including a member that extends further longitudinally from the discharge orifice than the support surface of said primary body;

a filter having first and second oppositely disposed faces, said filter being maintained in the cavity of said nozzle body with the first face of said filter contacting both the support surface of said primary body and the extending member of said swirl plug; and a retainer plug that is removably secured in the inner cavity of said nozzle body, said retainer plug having a clamping surface that contacts the second face of said filter and maintains the first face of said filter in contact with both the support surface of said primary body and the extending member of said swirl plug, said extending member deflecting the center of said filter with respect to the periphery of said filter in a longitudinal direction away from said discharge orifice.

* * * * *